United States Patent [19]

Fries et al.

[11] Patent Number: 4,479,679

[45] Date of Patent: Oct. 30, 1984

[54] BODY WEIGHT CHAIR CONTROL

[75] Inventors: Bernard J. Fries, Tustin, Calif.; Frederick S. Faiks, Greenville; Donald D. Korell, Ada, both of Mich.

[73] Assignee: Steelcase Inc., Grand Rapids, Mich.

[21] Appl. No.: 271,665

[22] Filed: Jun. 8, 1981

[51] Int. Cl.[3] ..... A47C 3/00

[52] U.S. Cl. ..... 297/300; 297/304; 297/321

[58] Field of Search ..... 297/300, 301, 304, 305, 297/316, 320, 321

[56] References Cited

U.S. PATENT DOCUMENTS

| | | | |
|---|---|---|---|
| 217,584 | 7/1879 | Chichester | 297/304 |
| 477,106 | 6/1892 | Davis | 297/304 |
| 2,272,980 | 2/1942 | McLellan et al. . | |
| 2,441,251 | 5/1948 | Raitch | 297/316 |
| 2,612,211 | 9/1952 | Gielow et al. . | |
| 2,615,496 | 10/1952 | Lorenz et al. . | |
| 2,646,839 | 7/1953 | Hillman | 297/313 |
| 2,650,646 | 9/1953 | Herold et al. | 297/301 |
| 2,760,556 | 8/1956 | Henrikson et al. . | |
| 2,830,650 | 4/1958 | Lorenz | 297/320 |
| 3,352,526 | 11/1967 | Anderson | 297/304 X |
| 3,356,413 | 12/1967 | Radke et al. . | |
| 3,386,770 | 6/1968 | Williams . | |
| 3,402,964 | 9/1968 | Williams . | |
| 3,537,674 | 11/1970 | Kobrehel . | |
| 3,602,537 | 8/1971 | Kerstholt . | |
| 3,740,792 | 6/1973 | Werner . | |
| 3,989,297 | 11/1976 | Kerstholt . | |
| 4,123,103 | 10/1978 | Doerner | 297/305 |
| 4,200,332 | 4/1980 | Brauning | 297/304 |
| 4,214,726 | 7/1980 | Karrip et al. | 297/304 |

FOREIGN PATENT DOCUMENTS

| | | | |
|---|---|---|---|
| 820791 | 8/1937 | France | 297/321 |
| 1102154 | 5/1955 | France | 297/321 |

*Primary Examiner*—Francis K. Zugel

*Attorney, Agent, or Firm*—Price, Heneveld, Huizenga & Cooper

[57] ABSTRACT

A chair control in which the chair occupant's body weight is the primary source of energy in reclining the chair and returning the chair to its task position includes a back support link and a front link, each pivotally mounted to a base link. A seat support link is pivotally mounted to and between the front link and the back support link. Pivoting of the links is restrained so that the front link extends upwardly and forwardly from said stationary link. The occupant's weight exerts a downward force on the front link, which exerts a forward force on the seat support link, which in turn exerts a forward force on the back support link providing a task position chair back support. A rearward force exerted on the back support link, as when the occupant reclines is partially counterbalanced by the above described forward force on the back support link so that no additional biasing means are necessary. The preferred embodiment includes biasing means to return the unoccupied chair control to the task position.

12 Claims, 7 Drawing Figures

BODY WEIGHT CHAIR CONTROL

BACKGROUND OF THE INVENTION

The present invention relates to chair controls and more specifically body weight chair controls in which the major force employed to return the chair to, and support the chair in, its upright or task position are supplied by the user's weight within the chair.

The present invention also relates to synchrotilt chair controls wherein the chair back and the chair seat both tilt, but at different rates, to maintain a comfortable dynamic interrelationship between the seat and back.

In contrast, most common types of chair controls include a control attached only to the chair seat such that the chair and back tilt at the same rate or a control attached only to the back such that the back tilts but the seat does not. In these controls, some type of relatively strong biasing means is necessary to return the occupied chair to its upright or task position. However, when the occupant of the chair increases the biasing force to obtain the desired task position support, the biasing force is too great to allow the occupant to remain comfortably in the reclined position. Conversely, if the occupant adjusts the control to decrease the biasing force to enable him to comfortably recline the chair, inadequate task support is provided.

Body weight chair controls typically require complex linkages for distributing the forces in the chair control so that the force exerted against the back of the chair when one tilts backwards is at least partially offset by the occupant's body weight upon the chair seat. Prior body weight controls typically provide linkage in the chair control between the back support and the seat support to push the seat forwardly and upwardly as the chair back is reclined. Examples of such structure are shown in U.S. Pat. Nos. 2,796,918 issued June 25, 1957 to Luckhardt, 2,760,556 issued Aug. 28, 1956 to Henrikson et al, and 2,612,211 issued Sept. 30, 1952 to Gielow et al. A serious problem with this arrangement is that the user has the feeling as he leans back that the chair back and seat are separating from one another due to the shift between the seat and the chair back as the chair is reclined and the seat is pushed forward. This action can cause some discomfort as the user's clothes are pulled in opposite directions.

Another prior approach is to pivot the chair seat and back precisely over the chair's center of gravity. Therefore, a slight shift of weight by the occupant will result in movement of the chair control. This construction is shown in U.S. Pat. No. 2,615,496 issued Oct. 28, 1952 to Lorenz et al. Because the center of gravity is so critically located, this chair does not provide the desired task support necessary for many functions such as typing and key punching. Furthermore, the chair seat tilts excessively as the chair reclines thereby tending to raise the user's feet off the floor.

SUMMARY OF THE INVENTION

These problems are solved by the present invention in which a chair control comprises four links pivotally mounted to one another in a manner so that as the chair back is reclined the chair seat is drawn rearwardly and upwardly. The force exerted on the chair back in reclining the chair is partially counterbalanced by the occupant's weight upon the chair seat. The links include a stationary link, front and back links pivotally mounted thereto, and a seat link pivotally mounted to and between the upper ends of the front and the back links.

The front link is constrained in movement to always extend upwardly and forwardly of the stationary link. This arrangement gives the chair control the desired task support so that a relatively large force is required to initially recline the chair from the task position. However, once tilting has begun, little additional rearward force is required to fully recline the chair so that the user is in a near equilibrium reclined position.

In one preferred embodiment of the invention, biasing means extend between two links of the chair control to return the chair to the upright or task position when unoccupied. Additionally, the springs provide additional task support as necessary to supplement the weight of the chair occupant. The spring can also be adjusted to alter the reclining characteristics of the chair as necessary.

The biasing structure can be employed for other chair controls and includes bias means mounted on bracket means pivotally coupled between a pair of chair control elements for biasing these elements toward each other.

These and other objects, advantages, and features of the invention will be more fully understood and appreciated by reference to the following written description and accompanying drawings.

DESCRIPTION OF THE PREFERRED EMBODIMENT

Figure 2:
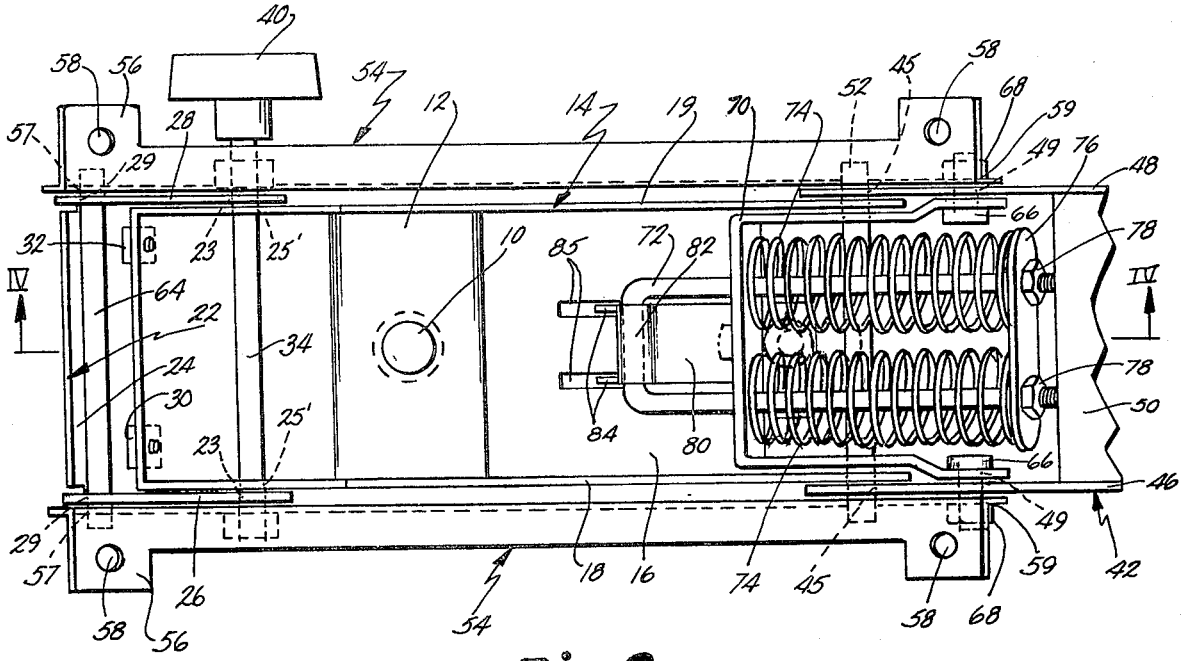
FIG. 2 is a fragmentary top plan view of the chair control shown in FIG. 1.

The chair control of the present invention generally comprises a stationary link or housing 14, front and back links 22 and 42 respectively pivotally mounted at their lower ends to opposite ends of stationary housing 14, and a pair of horizontally spaced seat links 54 pivotally mounted to and between the upper end of front link 22 and the upper end of back link 42. Bias means such as springs 74 are provided as described in detail below to bias back link 42 forwardly so that the unoccupied chair will return to its forward, or task position.

Figure 4:
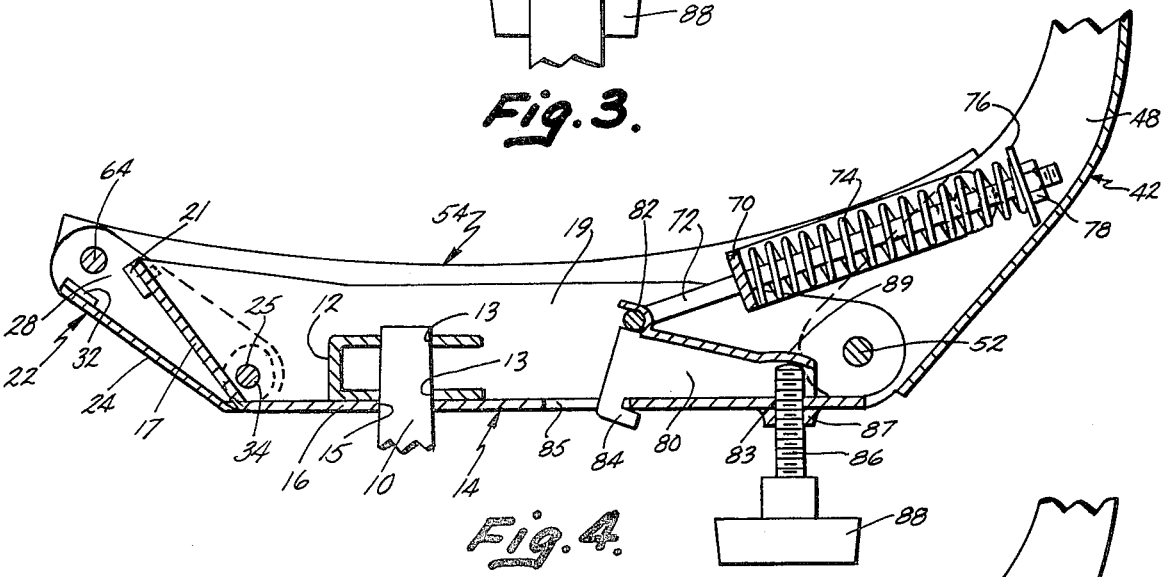
FIG. 4 is a fragmentary cross sectional view of the chair control taken along section line IV—IV of FIG. 2.
Figure 6:
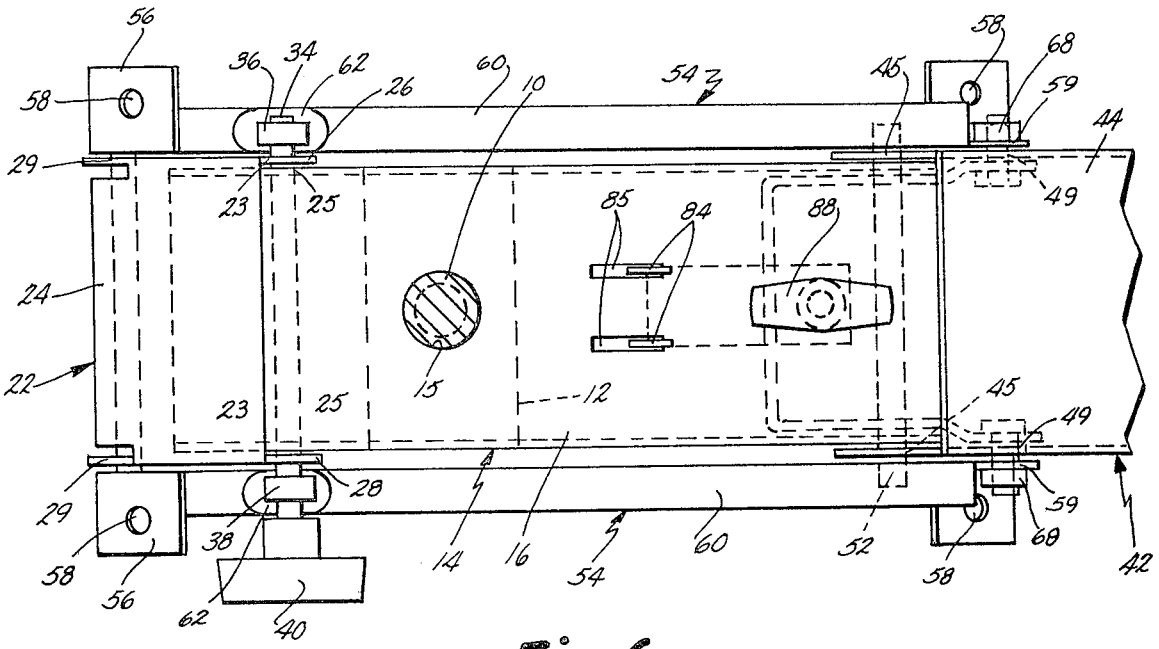
FIG. 6 is a fragmentary bottom plan view partly in cross section of the chair control shown in FIG. 1.

Stationary housing 14 forms the bottom link of the chair control and comprises, as best seen in FIGS. 2, 4 and 6, a substantially flat, horizontally extending, housing pan 16, having an upwardly inclined forward portion 17 formed upwardly, not past the perpendicular and horizontally spaced housing sides 18 and 19 located on either side of housing pan 16, and extending generally vertically and upwardly therefrom. Stop pads 21 are secured to the forward portion 17 near its upper outer edge, for a reason which will be described below.

Welded laterally centrally to pan 16 is a spindle support 12 comprising a generally rectangular, U-shaped bracket, with its lower leg welded to the upper surface of housing pan 16 and its edges welded to sides 18 and 19. Support 12 includes vertically aligned apertures 13 (FIG. 4) extending through its legs, and aligned with aperture 15 in pan 16 for receiving spindle 10 to support the chair control thereon.

Figure 5:
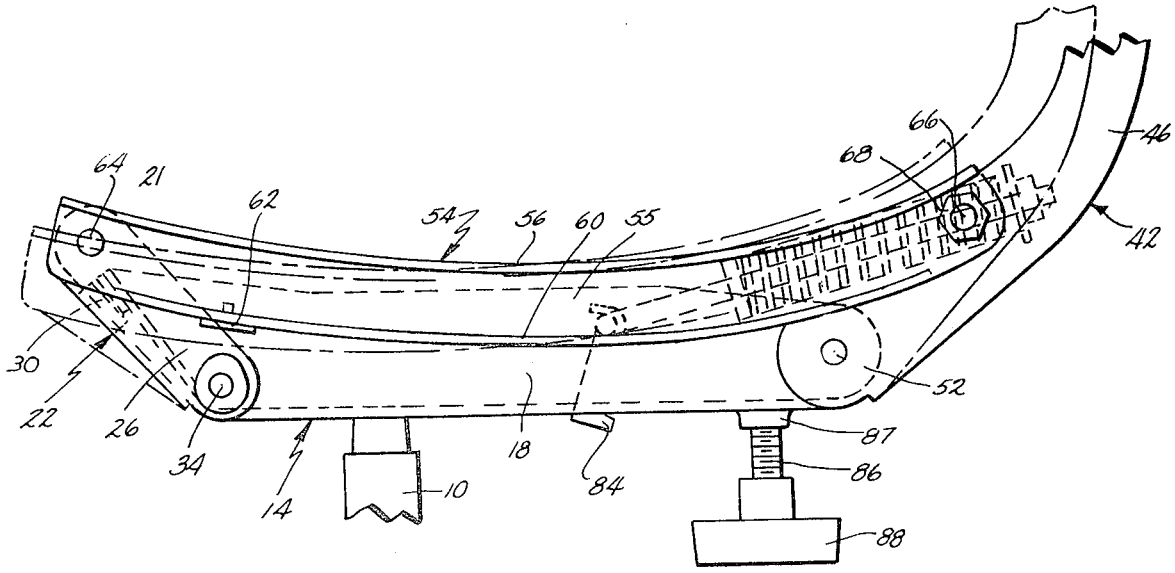
FIG. 5 is a fragmentary side elevational view of the chair control of FIG. 1 shown in a reclined position with the task position of the chair control shown in phantom form.

Front link 22 comprises a substantially flat front link pan 24 (FIGS. 2, 4 and 6) and horizontally spaced front link sides 26 and 28 attached to either side of front link pan 24. Front link 22 is pivotally mounted to the forward lower corner of stationary housing 14 by passing a cam axle 34 through apertures 25 (FIGS. 2 and 4) in housing sides 18 and 19 and apertures 23 in front link sides 26 and 28. Cam axle 34 is secured in position by attaching it by, for example, spot-welding to either one or both of housing sides 18 and 19. When so mounted, front link 22 is free to rotate about cam axle 34 in a substantially vertical plane. Stop plates 30 and 32 are secured to the upper surface of front link pan 24 in a position so that same will contact stop pads 21 when front link 22 is rotated upwardly about cam axle 34 when the chair is in a reclined position as seen in FIG. 5.

Figure 3:
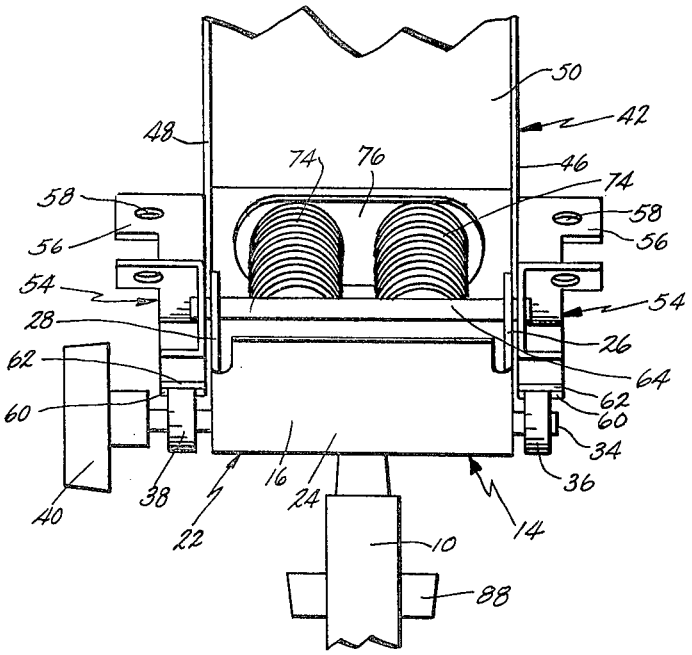
FIG. 3 is a fragmentary front elevational view of the chair control shown in FIG. 1.

Back link 42 comprises a forwardly concave, curvilinear back link pan 44 and horizontally spaced, forwardly extending back link sides 46 and 48 integrally formed along the edges of back link pan 44. Dress plate 50 (FIG. 3) which is generally U-shaped in cross section is secured between back link sides 46 and 48 to provide a planar surface at the location where the chair back (not shown) and the chair seat (not shown) meet when secured to the chair control. Back link 42 is pivotally mounted at its lower forward end to stationary housing 14 by passing a rear axle 52 through apertures 23 in housing sides 18 and 19 and apertures 45 in back link sides 46 and 48. Rear axle 52 is secured in position by spot-welding it to one of the housing sides 18 and 19. When so mounted, back link 42 is free to rotate about rear axle 52 in a substantially vertical plane.

Two horizontally spaced parallel seat links 54 complete the four bar link chair control and comprise substantially flat, arcuate plates 55. Each link 54 integrally includes an outwardly extending seat securing flange 56 extending along the upper edge of, and substantially perpendicular to, seat plates 55. Seat securing apertures 58 are formed through each seat securing flange 56 at enlarged portions at opposite ends to provide means for securing a chair seat (not shown) to the chair control. Seat links 54 are pivotally mounted to front link 22 by a front axle 64 extending through apertures 57 in seat links 54 near their forward ends and apertures 29 in front link sides 26 and 28 at their forward ends. Front axle 64 is secured in position by welding it to both side walls 26 and 28. When so mounted, plates 55 are free to rotate about front axle 64 in a substantially vertical plane. Seat plates 55 are pivotally mounted to back link sides 46 and 48 by passing bolts 66 through apertures 59 formed through seat plates 55 and apertures 49 through back link sides 46 and 48 above and rearward of axle 52. This mounting is completed by securing nuts 68 on bolts 66. When so mounted, seat links 54 are free to rotate about bolts 66 in a substantially vertical plane.

A pair of cam flanges 60 extend outwardly from and run along the lower edge of each seat plate 55. Cams 36 and 38 are secured to the portions of cam axle 34 extending outwardly beyond front link sides 26 and 28. Cam followers 62 are positioned on the undersurface of cam flanges 60 in a position to engage cams 36 and 38 when front link 22 is moved downwardly, (i.e. with the chair control holding the chair in an upright position). This cam means limits the motion of front link 22 in a downward direction to provide an adjustable upright position for the chair. A knob 40 is secured to cam axle 34 so that cam axle 34, with cams 36 and 38 thereon, may be easily rotated to change the angular orientation of cams 36 and 38, and consequently the inclination of seat links 54 when the chair is in the task (i.e. upright) position.

A generally U-shaped spring saddle 70 is pivotally mounted at its terminal ends on bolts 66 and extends generally forwardly and downwardly therefrom. A spring yoke rod 72 is also generally U-shaped and extends through the bottom segment of spring saddle 70. Compressive springs 74 are inserted over either leg of spring yoke 72 and secured thereon by a spring plate 76, which is in turn secured to threaded ends of yoke 72 by yoke nuts 78.

Figure 1:
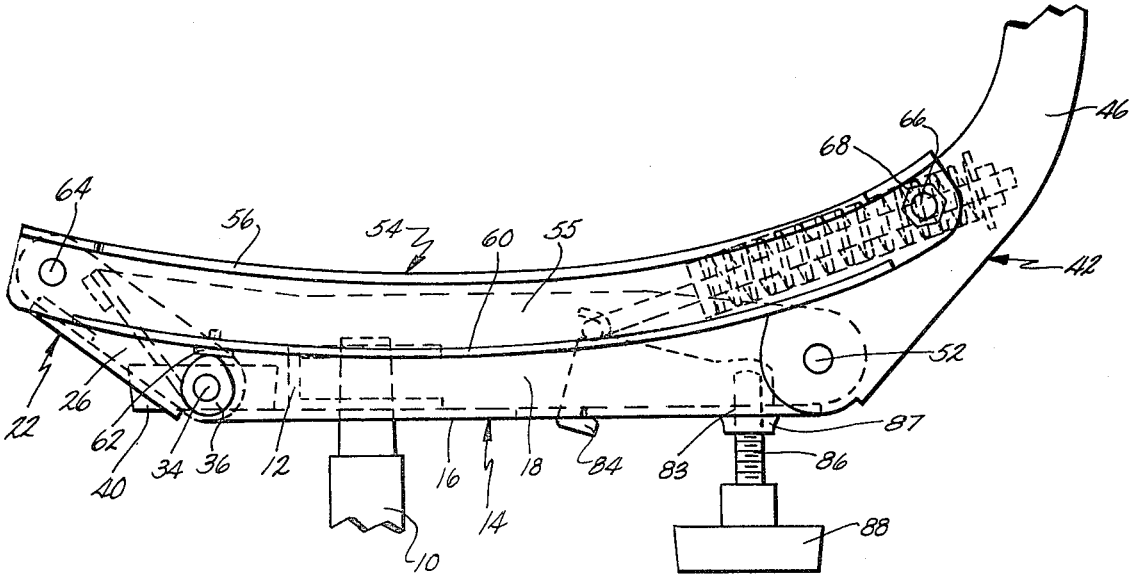
FIG. 1 is a fragmentary side elevational view of the chair control of the present invention mounted on a standard chair base spindle.

An adjusting arm 80, U-shaped in cross section and opening downwardly, includes an L-shaped yoke-retaining flange 82 extending upwardly and forwardly from the forward edge of the upper surface of arm 80. L-shaped hooks 84 extend downwardly and rearwardly from the lower edge of arm 80 and extend through a pair of spaced slots 85 in pan floor 16 so as to pivotally hook onto housing pan as best seen in FIGS. 1, 2 and 4. The bottom segment of spring yoke 72 fits within yoke-retaining flange 82, drawing spring yoke 72 forwardly and compressing springs 74 between saddle 70 and spring plate 76. A spring adjusting screw 86 is threaded through an aperture 83 in housing pan 16 so that the upper end of spring adjusting screw 86 presses upwardly against back end 89 of adjusting arm 80 as best seen in FIG. 4. A threaded adjusting screw boss 87 is welded to the undersurface of housing pan 16 to reinforce the threaded interconnection between spring adjusting screw 86 and housing pan 16. An adjusting knob 88 is secured to the lower end of spring adjusting screw 86 facilitating rotation thereof.

The compression of springs 74, and thus the bias force applied to return the chair control and associated chair to an upright position, may be varied by rotating spring adjusting screw 86. Spring adjusting screw 86 pivots adjusting arm 80 up or down around pan hooks 84 which move yoke-retaining flange 82 forwardly or rearwardly. The position of yoke-retaining flange 82 determines the extent of the compression of springs 74 and therefore the initial biasing of the chair control.

Figure 7:
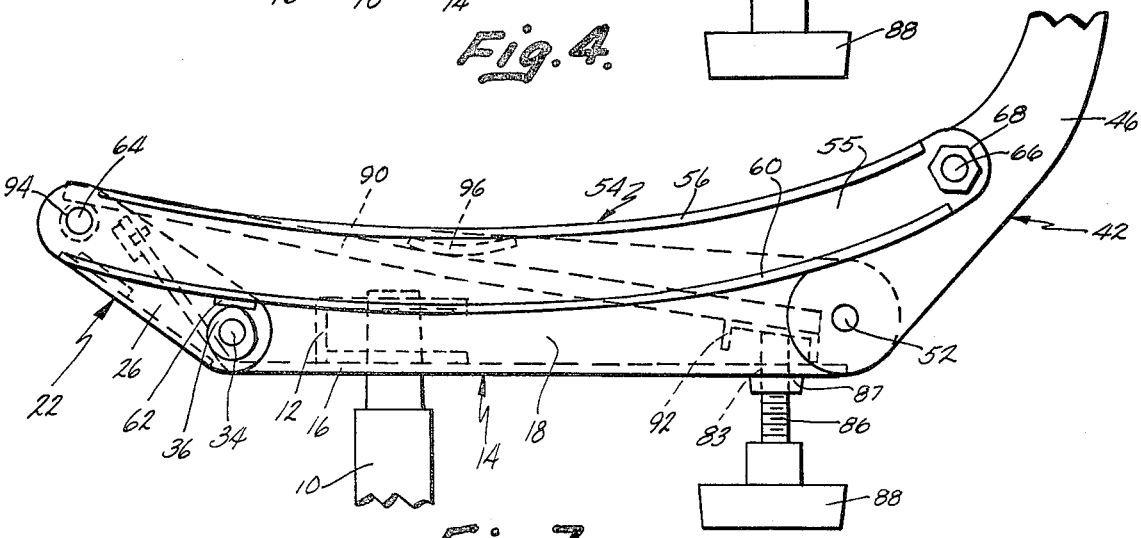
FIG. 7 is a fragmentary side elevational view of an alternative embodiment of the chair control of the present invention.

An alternative biasing means is shown in FIG. 7 wherein a flat spring 90 is employed in place of coil springs 74 of the previous embodiment. A spring roller 94 is cylindrical in shape and rotatably positioned over front axle 64 and extends substantially the entire distance between front link sides 26 and 28. Flat spring 90 is generally rectangular in shape and constructed of a stiffly resilient, flexible material such as that sold by Minnesota Mining & Manufacturing Co. under the registered trademark "SCOTCHPLY". A downwardly opening, U-shaped bracket 92 is secured to the back end of flat spring 90. Thus, flat spring 90 is supported at its front end on spring roller 94 and at its back end by adjusting screw plate 92 resting on spring adjusting screw 86. Fulcrum 96 is made of a substantially rigid material and is secured between housing sides 18 and 19, so as to press downwardly against flat spring 90. This flat spring biases the chair control into its forward, or task, position as flat spring 90 exerts a downward force upon spring roller 94 and consequently front link 22.

Assembly of a chair incorporating the chair control described herein is completed by securing a chair base (not shown) to spindle support 12, a chair seat (not shown) to seat links 54, and a chair back (not shown) to back link 42.

OPERATION

When one sits in a chair embodying the present chair control, a portion of the user's body weight exerts a downward force on front link 22 which produces a forward force on seat links 54, which in turn produces a forward force on back link 42. Consequently, back link 42 provides good back support for the user while the chair is in the task position.

When the user desires to recline, he leans backward which both exerts rearward force on back link 42 and reduces the portion of the user's weight over front link 22. Eventually, the rearward force exerted on seat links 54 by back link 42 will surpass the forward force exerted on seat links 54 by front link 22, and the chair control will begin to shift the chair to a reclined position with front link 22 rotating upwardly and back link 42 rotating rearwardly. As the chair control reclines, the chair seat is drawn rearwardly, and the forward edge of the chair seat is drawn upwardly as front link 22 rotates upwardly. As long as sufficient rearward force is applied, this movement will continue until stop plates 30 and 32 make contact with stop pads 21 at which point the chair control can no longer pivot to the rear. The chair is then in its most reclined position.

The process for returning the chair control to its upright, or task position, is exactly opposite to that of moving it to a reclined position. The user shifts his weight forward which both reduces the rearward force on back link 42 and applies additional weight over front link 22. Eventually, the forward force applied to seat links 54 by front link 22 will be greater than the rearward force applied to seat links 54 by back link 42. At this time, the chair control will begin shifting forward. If the force is sufficient, this motion will continue until cam pads 62 come in contact with cams 36 and 38.

Variations in the "feel" of the chair control (i.e. the force required to move the chair control) can be made by varying (1) the lengths of the links, (2) the initial orientation of the links, or (3) the biasing force in the spring. By constraining the movement of front link 22 to always extend upwardly and forwardly of housing 14, it is assured that the chair control will provide the desired task support so that a relatively large force is required to initially recline the chair from the task position. When the chair is reclined, it is in a nearly equilibrium condition with relatively little force required to move the chair in either direction.

We have found that the following dimensions of the preferred embodiment provide a chair having appropriate reclining characteristics for a wide variety of user body weights. The distance between cam axle 34 and rear axle 52 is about 6½ inches, between cam axle 34 and front axle 64 3½ inches, between rear axle 52 and bolts 66 1¾ inches, and between front axle 64 and bolts 66 10 inches. A line drawn through cam axle 34 and rear axle 52 is generally parallel to the floor. When the chair control is in the task or upright position, a line drawn between cam axle 34 and front axle 64 is inclined about 27° above horizontal, and a line through rear axle 52 and bolts 66 is inclined approximately 73° from horizontal. When the chair control is fully reclined, a line drawn between cam axle 34 and front axle 64 is inclined about 32° above horizontal. In the preferred embodiment, hooks 84 are installed in housing pan 16 approximately midway between cam axle 34 and rear axle 52. The spring assembly is adjustable.

Of course, it is understood that the above is merely a preferred embodiment of the invention and that various changes and alterations can be made without departing from the spirit and scope of the invention as defined in the appended claims.

The embodiments of the invention in which an exclusive property or privilege is claimed are defined as follows:

1. A body weight chair control comprising:

a stationary housing including a substantially flat housing pan having a forward end bent upwardly not past a right angle and first and second substantially parallel, spaced housing sides secured to said housing pan;

means for securing said stationary housing to a chair base;

means for supporting a chair back;

first means pivotally mounting said chair back support means to said stationary housing;

a front link including a substantially flat front link pan and first and second substantially parallel, spaced front link sides secured to said front link pan;

second means forward of said first pivotal mounting means pivotally mounting said front link to said stationary housing including a cam axle passing through said first and second housing sides and said first and second front link sides, said cam axle having first and second ends;

means for supporting a chair seat including first and second flat arc-shaped, vertically oriented seat plates each having an upper and lower edge, first and second cam flanges extending laterally from said lower edge of said first and second seat plates respectively, and first and second seat securing flanges extending laterally from said upper edge of said first and second plates respectively;

third means pivotally mounting said chair seat support means to said front link;

fourth means pivotally mounting said chair seat support means to said chair back support means, said first, second, third, and fourth pivotal mounting means being mutually exclusive, said fourth pivotal mounting means located above said first pivotal mounting means;

means for restricting movement of said front link such that said front link regardless of its orientation extends upwardly and forwardly from said stationary housing so that said third pivotal mounting means is located above and forward of said second pivotal mounting means, said front link restricting means including first and second cams mounted on first and second extensions of said first and second cam axle ends, said first and second cam flanges contacting said cams if said front link is rotated in a first direction, said means further including said front link pan contacting said housing pan if said front link is rotated in a second direction opposite to said first direction; and spring means for biasing said chair seat support toward a forward or task position.

2. The body weight chair control of claim 1 wherein said chair back support means comprises a forwardly concave back link pan and first and second substantially parallel, spaced back link sides secured to said back link pan.

3. The body weight chair control of claim 1 wherein said first pivotal mounting means comprises a rear axle passing through said first and second housing sides and said first and second back link sides.

4. The body weight chair control of claim 1 wherein said third pivotal mounting means comprises a front axle passing through said first and second front link sides and said first and second seat plates.

5. The body weight chair control of claim 1 wherein said fourth pivotal mounting means comprises:

a first bolt passing through said first housing side and said first seat plate; and a second bolt passing through said second housing side and said second seat plate.

6. The body weight chair control of claim 1 wherein a cam axle knob is secured to one of said first or second extensions so that said cam axle may be rotated changing the orientation of said cams.

7. The body weight chair control of claim 1 wherein said spring means is operably mounted to and between said fourth pivotal mounting means and said stationary housing.

8. The body weight chair control of claim 7 wherein said biasing means comprises:

a U-shaped spring saddle having a bottom segment and first and second side segments, said side segments pivotally mounted on said fourth pivotal mounting means;

a U-shaped spring yoke having a bottom section and first and second side sections, said side sections slidably mounted through said bottom segment of said spring saddle;

first and second coil springs slidably mounted on said first and second sections of said spring yoke;

means for preventing said springs from extending beyond the terminal ends of said side sections so that said springs are trapped between said preventing means and said spring saddle; and means for maintaining said bottom section of said spring yoke in fixed relation to said housing pan.

9. The body weight chair control of claim 8 wherein said bottom section maintaining means comprises:

an adjusting arm hingedly mounted to said housing pan, said adjusting arm being U-shaped in cross section;

means for maintaining said adjusting arm in fixed relation to said housing pan; and an L-shaped yoke-retaining flange extending upwardly and forwardly from said adjusting arm, said bottom section of said spring yoke being positioned in said yoke-retaining flange.

10. The body weight chair control of claim 9 wherein said adjusting arm maintaining means comprises an adjusting screw screwably mounted through said housing pan, said adjusting screw having upper and lower ends, the upper end of said adjusting screw abutting said adjusting arm so that the position of said adjusting arm may be varied by rotating said adjusting screw.

11. The body weight chair control of claim 10 further comprising an adjusting knob secured to said lower end of said adjusting screw to facilitate rotation of the adjusting screw.

12. The body weight chair control of claim 11 wherein said preventing means comprises:

a flat spring plate slidably mounted on said first and second side sections of said spring yoke; and first and second spring yoke nuts screwably mounted on said first and second side sections respectively to retain said spring plate on said first and second side sections.

* * * * *